United States Patent [19]

Amamo et al.

[11] Patent Number: 4,630,206

[45] Date of Patent: Dec. 16, 1986

[54] METHOD OF FUEL INJECTION INTO ENGINE

[75] Inventors: Matsuo Amamo; Takao Sasayama, both of Hitachi, Japan

[73] Assignee: Hitachi, Ltd., Tokyo, Japan

[21] Appl. No.: 615,525

[22] Filed: May 31, 1984

[30] Foreign Application Priority Data

May 31, 1983 [JP] Japan ..... 58-95034

[51] Int. Cl.[4] ..... F02B 3/00

[52] U.S. Cl. ..... 364/431.07; 123/492; 123/493

[58] Field of Search ..... 364/431.07, 431.05, 364/431.04; 123/480, 492, 493

[56] References Cited

U.S. PATENT DOCUMENTS 4,257,377 3/1981 Kinugawa et al. ..... 123/492
4,424,568 1/1984 Nishimura et al. ..... 364/431.07
4,434,768 3/1984 Ninomiya ..... 123/493

FOREIGN PATENT DOCUMENTS 0070926 5/1982 Japan ..... 123/492

*Primary Examiner*—Parshotam S. Lall
*Attorney, Agent, or Firm*—Antonelli, Terry & Wands

[57] ABSTRACT

A method for controlling an engine includes the steps of sampling instantaneous flow rates of intake air supplied to the engine, computing the quantity of intake air to be supplied to the engine in an intake stroke on the basis of the sampled instantaneous intake air flow rates, computing the quantity of injected fuel in the intake stroke on the basis of the computed intake air quantity, and injecting the computed quantity of fuel to the engine. In the method, the step of computing the injected fuel quantity includes the step of computing the ratio between the instantaneous intake air flow rate sampled at a reference timing in the preceding intake stroke and that sampled at reference timing in the present intake stroke for correcting the quantity of intake air supplied in the present intake stroke.

3 Claims, 10 Drawing Figures

METHOD OF FUEL INJECTION INTO ENGINE

This invention relates to a method of controlling fuel-injection in an engine, such as a gasoline engine used, for example, in an automobile, and more particularly to a method of controlling fuel-injection in an engine of the type controlled by a digital computer.

In an internal combustion engine, such as a gasoline engine (referred to hereinafter merely as an engine), it is necessary to maintain the air-fuel ratio within a proper range depending on the operating condition of the engine. To this end, it is necessary to accurately measure the flow rate of intake air introduced into the engine.

It is commonly known that the flow rate of intake air introduced into an engine is not maintained constant during rotation of the engine but pulsates as shown in FIG. 1. FIG. 1 shows the air flow rate q, the intake strokes A to D in individual cylinders and the fuel injection periods Fa to Fd in the individual intake strokes relative to the rotation angle of the engine shaft (referred to hereinafter as a crank angle) when the engine is a four-cylinder engine. Therefore, the quantities of intake air introduced into the individual cylinders are given by the values Qa, Qb, Qc and Qd obtained by integrating the air flow rate q within the crank angle of 180°.

Then, on the basis of the quantities of intake air Qa to Qd thus measured or computed, the lengths of the fuel injection periods Fa to Fd are determined so as to maintain a predetermined air-fuel ratio. In order to determine the fuel injection period Fb in the intake stroke B of the third cylinder, for example, this fuel injection period Fb must primarily be controlled on the basis of the intake air quantity Qb. However, since the intake air quantity Qb in this fuel injection period Fb is not established yet, it is a common practice to determine the fuel injection period Fb on the basis of the quantity of intake air Qa in the intake stroke A of the first cylinder which intake stroke has taken place immediately before the intake stroke B of the third cylinder. Similarly, each of the other fuel injection periods Fa, Fc and Fd must be determined on the basis of the intake air quantity in the immediately preceding intake stroke of another cylinder.

Thus, according to such a fuel injection control method using an intake air flow sensor for the control, the quantity of injected fuel in the present intake stroke is determined on the basis of the quantity of intake air measured in the immediately preceding intake stroke, resulting in a time lag in the control.

Although such a manner of fuel injection control does not raise any practical problem insofar as there is no change in the operating condition of the engine, a serious problem arises in a transient state in which the engine is accelerated or decelerated. That is, in the case of acceleration of the engine, the quantity of injected fuel is always determined on the basis of the quantity of intake air smaller than the actual intake air quantity due to the time lag in the control above described, with the result that the air-fuel mixture becomes too lean to sufficiently accelerate the engine, giving rise to a discontinuity of the rotation speed of the engine. On the other hand, in the case of deceleration, the quantity of injected fuel is always determined on the basis of the quantity of intake air larger than the actual intake air quantity due to the time lag in the control, with the result that the air-fuel ratio is reduced to provide a richer air-fuel mixture, giving rise to an undesirable increase in the concentration of carbon monoxide (CO) in the engine exhaust gases.

A prior art method of fuel injection control has proposed to obviate such a problem encountered in the acceleration and deceleration of an engine so that acceleration coefficients and deceleration coefficients for the acceleration and deceleration respectively of the engine are set in a control system, and, depending on the detected level of acceleration or deceleration, a suitable one of the acceleration or deceleration coefficients is selected or determined to be used for the control of fuel injection. The details of such a method are disclosed in U.S. Pat. No. 4,424,568.

However, such a manner of determining the acceleration and deceleration coefficients has a drawback in that the response is not sufficiently quick, and, during a mode of acceleration in which acceleration and deceleration are frequently repeated, a phenomenon (referred to hereinafter as a CO spike phenomenon) appears in which the concentration of carbon monoxide (CO) in the exhaust gases shows an abrupt increase. Thus, the proposed method has raised the problem of discharge of a large quantity of harmful CO from the engine.

It is therefore a primary object of the present invention to provide a novel and improved method of fuel control which can minimize the CO spike phenomenon tending to appear during repeated acceleration and deceleration of an engine.

The present invention which attains the above object is featured in that, on the basis of the ratio between the instantaneous flow rate of intake air sampled at a predetermined sampling point in an intake stroke immediately preceding the present intake stroke in an engine and the instantaneous flow rate of intake air sampled at a predetermined sampling point in the present intake stroke, the total quantity of intake air in the present intake stroke is predicted from the actually measured quantity of intake air in the immediately preceding intake stroke, and, on the basis of the thus predicted quantity of intake air in the present intake stroke, the quantity of fuel to be injected in the present intake stroke is controlled.

The present invention will be apparent from the following detailed description taken in conjunction with the accompanying drawings, in which.

A preferred embodiment of the fuel injection control method according to the present invention will now be described in detail with reference to the drawings.

Figure 2:
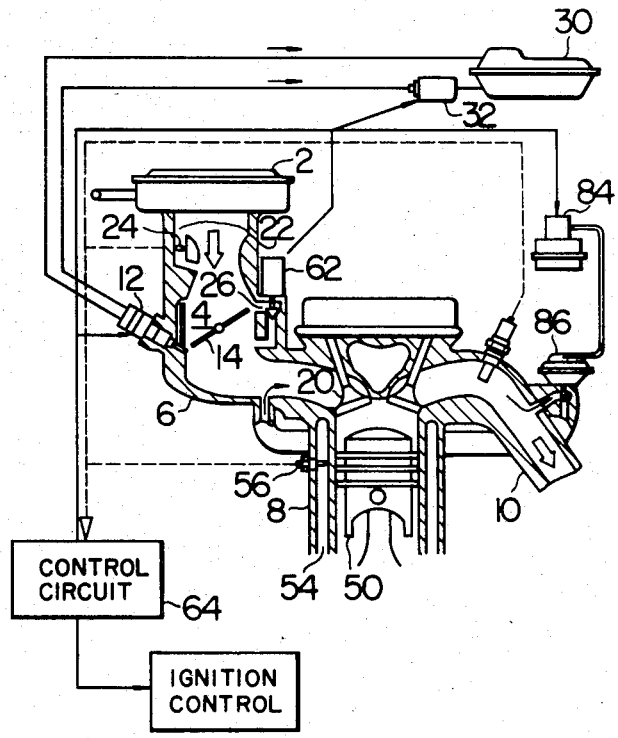
FIG. 2 is a partly sectional, system diagram showing an example of an engine to which a preferred embodiment of the present invention is applied.

FIG. 2 is a partly sectional, system diagram showing an example of an engine to which a preferred embodiment of the present invention is applied. Referring to FIG. 2, intake air passes through an air cleaner 2, a throttle chamber 4 and an intake pipe 6 to be supplied to a cylinder 8 of an engine. Gases produced as a result of combustion in the cylinder 8 are discharged from the cylinder 8 to the atmosphere via an exhaust pipe 10.

An injector 12 for fuel injection is provided in the throttle chamber 4. Fuel ejected from the fuel injector 12 is atomized in the air path of the throttle chamber 4 and is mixed with intake air to form a fuel-air mixture which flows through the intake pipe 6 to be supplied into the combustion chamber of the cylinder 8 when an intake valve 20 is opened.

A throttle valve 14 is disposed in the vicinity of the outlet of the injector 12. The throttle valve 14 is arranged for mechanical interlocking operation with the accelerator pedal actuated by the driver of the vehicle.

An air passage 22 is provided upstream of the throttle valve 14 in the throttle chamber 4. An electrical heat generator 24 constituting part of a thermal air flow meter is disposed in this air passage 22 to generate an electrical signal determined by the relation between the velocity of air and the heat transmitted from the heat generator 24. The heat generator 24 disposed in the air passage 22 is protected from high-temperature gases that may be produced by back fire and protected also from contamination due to dust or like foreign matter that may be contained in the intake air. The outlet of the air passage 22 opens in the vicinity of the narrowest portion of the venturi, and its inlet opens in the upstream portion of the venturi.

Although not shown in FIG. 2, a throttle sensor 116 (FIG. 3) is associated with the throttle valve 14 to sense the opening of the throttle valve 14. The output signal of the throttle sensor 116 shown in FIG. 3 described later is applied to a multiplexer 120 of a first analog-digital converter.

Fuel is supplied under pressure to the injector 12 from a fuel tank 30 through a fuel pump 32.

The fuel-air mixture supplied from the intake valve 20 into the cylinder 8 is compressed by a piston 50 and then ignited by a spark generated by a spark plug (not shown) so that the combustion is converted into kinetic energy. The cylinder 8 is cooled by cooling water flowing through a cooling jacket 54. The temperature of the cooling water is measured or sensed by a cooling water sensor 56 whose output signal is utilized as an indication of the engine cooling water temperature. An ignition coil (not shown) applies a high voltage across the spark plug at the ignition timing.

A crank angle sensor 146 (FIG. 3) mounted on the crank shaft (not shown) generates a reference angle signal indicative of a reference crank angle and also a crank position signal indicative of a predetermined small crank angle, with the rotation of the engine.

The output signals from the crank angle sensor 146 are applied together with the output signal from the cooling water temperature sensor 56 and the output signal from the air flow sensor 24 to a control circuit 64 which may be a microcomputer, and the control circuit 64 generates output signals for controlling, for example, the injector 12 and ignition coil for effecting the ignition control.

A bypass 26 bypassing the throttle valve 14 and communicating with the intake pipe 6 is provided in the throttle chamber 4, and an on-off controlled bypass valve 62 is associated with the bypass 26. A control input is applied to a driver of this bypass valve 62 from the control circuit 64 to control the on-off operation of this bypass valve 62.

The bypass valve 62 is disposed to controllably close the inlet of the bypass 26 bypassing the throttle valve 14, and a pulse current is supplied to control the on-off operation of the bypass valve 62. In other words, the lifting of the valve member of this bypass valve 62 is controlled to change the cross-sectional area of the bypass 26, and an output signal from the control circuit 64 is applied to a drive system to control the lifting of the valve member of the bypass valve 62. That is, the control circuit 64 generates an on-off period signal for controlling the drive system, and, in response to the on-off period signal, the drive system applies a control signal to the driver of the bypass valve 62 so as to regulate the lifting of the valve member of the bypass valve 62.

The negative pressure in the intake pipe 6 is applied through a control valve 86 to a pressure regulating valve 84 for controlling the rate of exhaust gas recirculation. Depending on the on-duty factor of the pulse signal of repetitive pulses applied from the control circuit 64, the pressure regulating valve 84 controls the percentage with which a predetermined negative pressure of the negative pressure source is liberated to the atmosphere, thereby controlling the application of the negative pressure to the control valve 86. Therefore, the negative pressure applied to the control valve 86 is determined by the on-duty factor of the pulse signal applied from the control circuit 64. Thus, the quantity of EGR from the exhaust pipe 10 to the intake pipe 6 is controlled.

Figure 3:
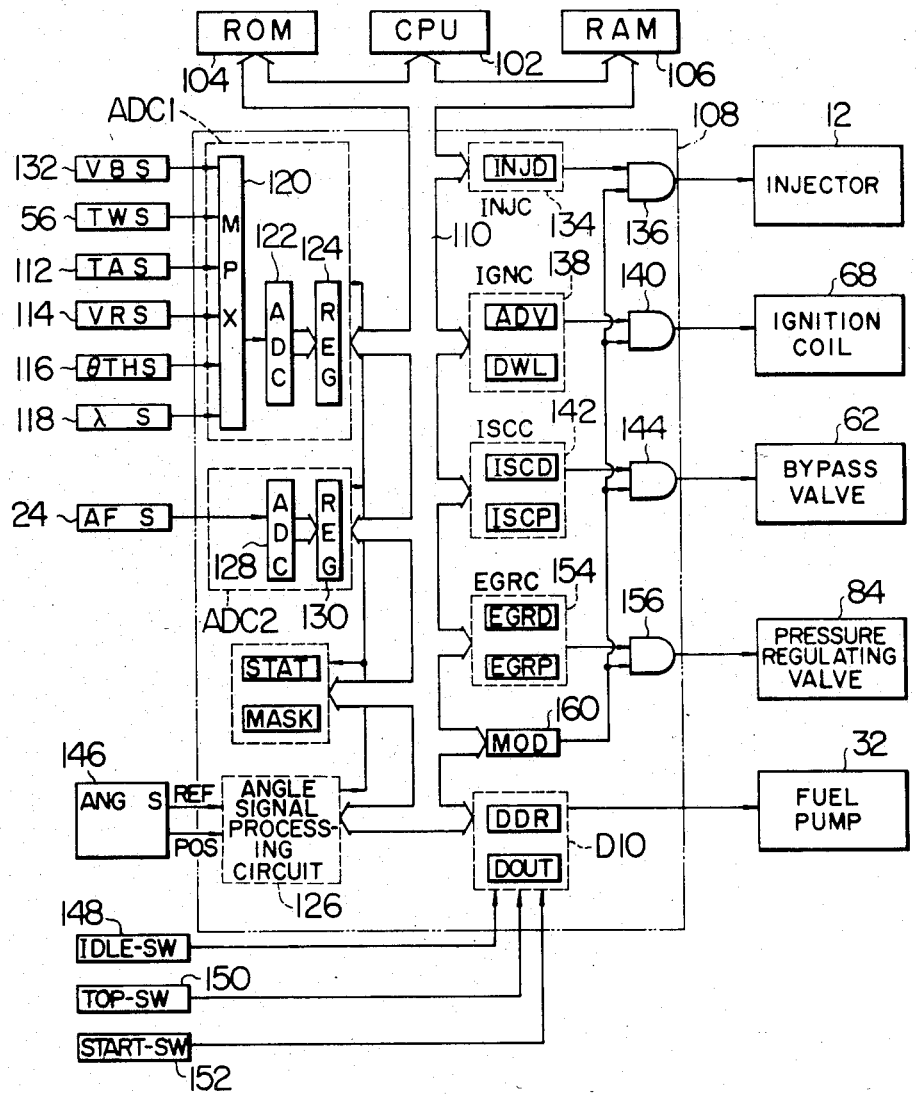
FIG. 3 is a block diagram showing the general structure of the control system shown in FIG. 2.

FIG. 3 is a block diagram showing the general structure of one form of the control system employed in the present invention, and the details thereof are disclosed in, for example, U.S. Pat. No. 4,276,601. The control system includes a CPU 102, a read-only memory 104 (abbreviated hereinafter as an ROM), a random access memory 106 (abbreviated hereinafter as an RAM) and an input/output (I/O) circuit 108.

According to various programs stored in the ROM 104, the CPU 102 effects arithmetic and logical processing on input data supplied from the I/O circuit 108 and returns the results of processing to the I/O circuit 108 again. The RAM 106 is used as an intermediate memory storing data required for these arithmetic and logical operations.

A bus line 110 including data buses, control buses and address buses is provided for the exchange of various data among the CPU 102, ROM 104, RAM 106 and I/O circuit 108.

The I/O circuit 108 includes a first analog-digital converter (abbreviated hereinafter as an $ADC_1$), a second analog-digital converter (abbreviated hereinafter as an $ADC_2$), an angle signal processing circuit 126, and a discrete input/output circuit (abbreviated hereinafter as a DIO) provided for the input and output of 1-bit information.

A battery voltage sensor 132 (referred to hereinafter as a VBS), the cooling water temperature sensor 56 (referred to hereinafter as a TWS), an atmospheric pressure sensor 112 (referred to hereinafter as a TAS), a regulated voltage generator 114 (referred to hereinafter as a VRS), the throttle sensor 116 (referred to hereinafter as a $\theta$THS) and a $\lambda$ sensor 118 (referred to hereinafter as a $\lambda$S) apply their output signals to a multiplexer 120 (abbreviated hereinafter as an MPX) in the $ADC_1$, and the MPX 120 selects one of these input signals to apply the same to an analog-digital conversion circuit 122 (abbreviated hereinafter as an ADC) in the $ADC_1$. The digital output signal of the ADC 122 is registered in a register 124 (abbreviated hereinafter as an REG) in the $ADC_1$.

The output signal of the air flow sensor 24 (referred to hereinafter as an AFS) is applied to the $ADC_2$. In the $ADC_2$, this input signal is converted into a digital signal by an analog-digital conversion circuit 128 (abbreviated hereinafter as an ADC), and the digital signal is set in a register 130 (abbreviated hereinafter as an REG).

As described already, the crank angle sensor 146 (referred to hereinafter as an ANGs) generates a reference signal (referred to hereinafter as a REF) indicative of a reference crank angle of, for example, 180° and generates also a crank position signal (referred to hereinafter as a POS) indicative of a very small crank angle of, for example, 1°. These output signals from the ANGs 146 are applied to the angle signal processing circuit 126 to be subjected to wave shaping.

An idle switch 148 (abbreviated hereinafter as an IDLE-SW), a top gear switch 150 (abbreviated hereinafter as a TOP-SW) and a starter switch 152 (abbreviated hereinafter as a START-SW) apply their output signals to the DIO.

Pulse output circuit generating pulse signals on the basis of the results of arithmetic and logical processing in the CPU 102 and the objects of control will now be described. An injector control circuit 134 (referred to hereinafter as an INJC) converts the digital value indicative of the computed quantity of injected fuel into a corresponding pulse signal. Therefore, the pulse signal having the pulse width corresponding to the computed quantity of injected fuel is registered in a register INJD in the INJC 134 to be applied to the injector 12 through an AND gate 136.

An ignition pulse generating circuit 138 (referred to hereinafter as an IGNC) includes a register ADV for setting the ignition timing and another register DWL for setting the starting time of supplying the primary current to the ignition coil 68, and these data are set in the registers ADV and DWL from the CPU 102. On the basis of the data set in the registers ADV and DWL, the IGNC 138 generates a pulse signal which is applied to the ignition coil 68 through an AND gate 140.

1-bit input and output signals are controlled by the I/O circuit 108. Input signals include the output signals from the IDLE-SW 148, TOP-SW 150 and START-SW 152. The D10 generates an output pulse signal which is applied to the fuel pump 32 to drive the same. The D10 includes a register DDR for determining whether the terminal is used as an input terminal or an output terminal, and another register DOUT for latching the output data.

A register 160 (referred to hereinafter as an MOD register) registers a command for commanding various internal states of the I/O circuit 108 and acts to turn on or off all of the AND gates 136, 140, 144 and 156. Thus, by setting a command in the MOD register 160, interruption of appearance of outputs from or starting of the INJC 134, IGNC 138, ISCC (an ignition control circuit) 142 and EGRC (a pulse generator circuit for producing a pulse signal for controlling the valve 84) 154 can be controlled.

It is already well known that the CPU 120 can execute various kinds of arithmetic and logical processing according to control programs stored previously in the ROM 104.

Figure 4:
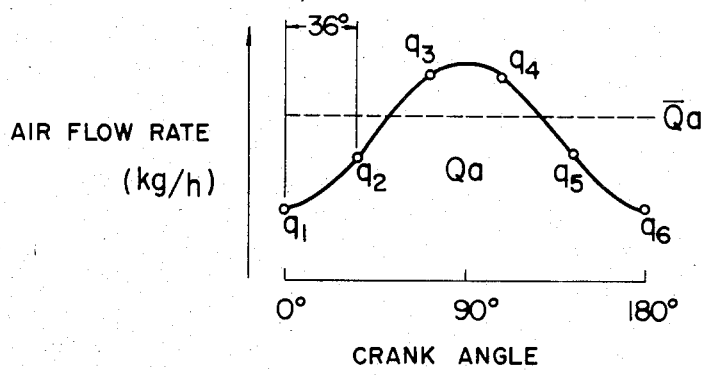
FIG. 4 illustrates a manner of processing the air flow signal generated from the air flow sensor shown in FIG. 1.

Description will then be directed to processing of the output signal of the air flow sensor 24. The inventors filed already Japanese Patent Application Laid-open No. 56-92330 (1981) corresponding to U.S. Pat. No. 4,523, 284 which discloses a method in which the output of such an air flow sensor is sampled in synchronism with the rotation of an engine to find the instantaneous flow rate of air. Such a signal processing method will be explained with reference to FIG. 4 when applied to a four-cylinder engine. As seen in FIG. 4, the output signal appearing from the AFS 24 in each intake stroke of 180° is sampled at intervals of the crank angle of 36°, and the resultant data registered sequentially in the REG 130 of the $ADC_2$ are read out and subject to linearization processing to obtain instantaneous air flow rates $q_1$ to $q_5$ in one intake stroke. The quantity of air Qa supplied during one intake stroke is provided by addition or integration of the instantaneous flow rates $q_1$ to $q_5$, and the average air quantity $\overline{Qa}$ is computed by dividing the air quantity Qa by five which is the number of sampling points. Therefore, the quantity of injected fuel $Q_f$ is given by the following equation:

$$Q_f = \frac{1}{5N} \cdot \sum_{m=1}^{5} qm \cdot (1 + Ki) \quad (1)$$

where

N: engine rotation speed in rpm

Ki: sum of various compensation factors determined by temperature of engine cooling water, length of time elapsed after starting, etc.

On the other hand, the injected fuel quantity $Q_f$ can be determined on the basis of the opening period ti of the injector 12 since the quantity of fuel injected per unit time from the injector 12 is previously determined and known. Therefore, the following equation (2) is derived from the equation (1):

$$ti = \frac{K}{N} \cdot \sum_{m=1}^{5} qm \cdot (1 + Ki) \quad (2)$$

where K: factor determined by injector

Figure 1:
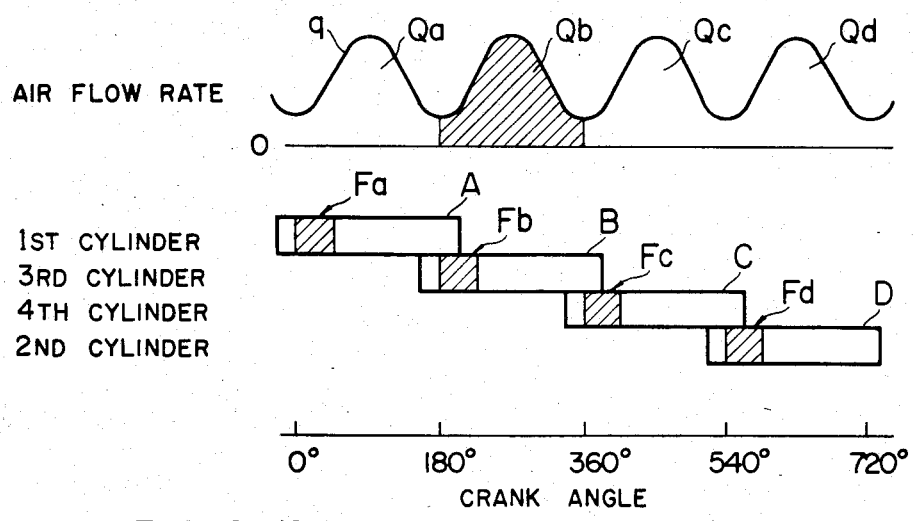
FIG. 1 illustrates the relation between the flow rate of intake air and the fuel injection timing in an engine.

As described already with reference to FIG. 1, this injector opening-period ti is reflected in the next intake stroke, and the quantity of fuel supplied in the next intake stroke is controlled on the basis of the quantity of intake air supplied in the immediately preceding intake stroke, resulting in a time lag in the control.

Therefore, such a manner of fuel control raises a serious problem in a transient state of engine operation although it does not lead to any serious problem in a steady state of engine operation, as pointed out already.

Figure 5:
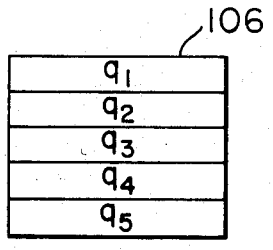
FIG. 5 illustrates how the air flow-rate data are sequentially stored in the RAM shown in FIG. 3.

According to the manner of signal processing described with reference to FIG. 4, the data indicative of the instantaneous air flow rates $q_1$ to $q_5$ sampled at intervals of the crank angle of 36° are sequentially stored in the RAM 106 in an order as shown in FIG. 5 to be used for the computation of the intake air quantity qa. Then, the data indicative of the instantaneous air flow rate $q_6$ sampled in the next intake stroke is stored in the address occupied previously by $q_1$ in the RAM 106, and so on.

The manner of signal processing according to an embodiment of present invention will now be described.

According to the embodiment of the present invention, the degree of acceleration or deceleration of the engine is judged by computing the rate of change of the output signal of the throttle sensor θTHS relative to time. When the rate of change of the throttle sensor output signal relative to time does not attain a predetermined level, such an acceleration or deceleration is called herein a low-rate acceleration or a low-rate deceleration respectively, while, when the change rate exceeds the predetermined level, such an acceleration or deceleration is called herein a high-rate acceleration or a high-rate deceleration, respectively. The quantity of injected fuel is controlled on the basis of such a classification according to the present invention.

Figure 6:
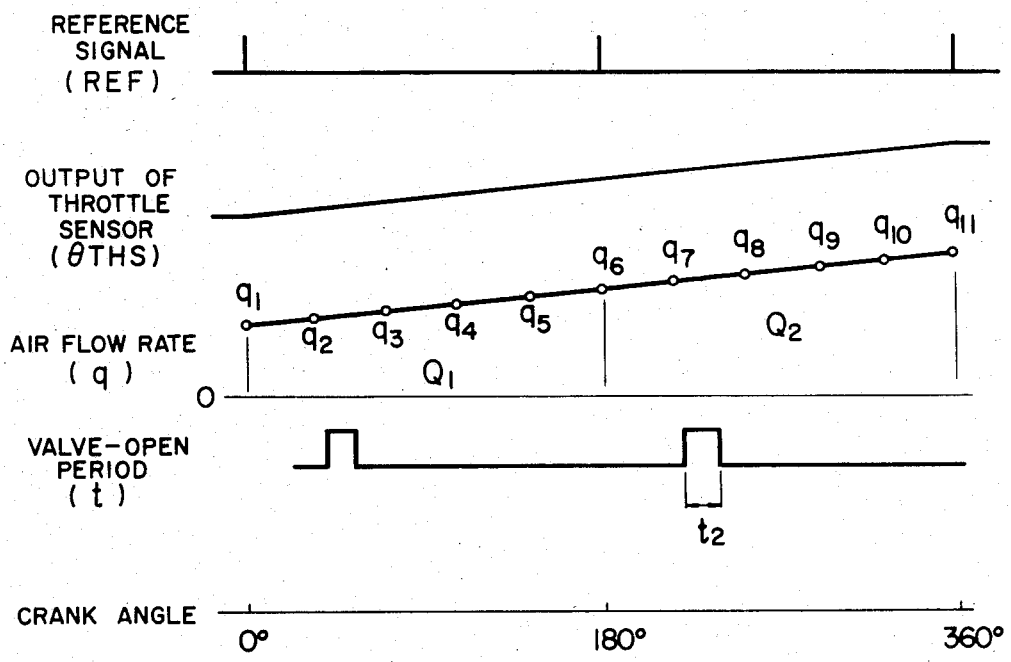
FIG. 6 illustrates the manner of signal processing according to the embodiment of the present invention in a low-rate acceleration mode in which the engine is relatively gradually accelerated.

FIG. 6 illustrates the fuel injection timing when the acceleration is judged to be a low-rate acceleration, and the manner of control in such a case will be described.

Referring to FIG. 6, upon completion of sampling to obtain data indicative of an instantaneous air flow rate $q_6$, the opening period $t_2$ of the injector 12 is computed according to the following equation (3) utilizing the equation (2):

$$t_2 = \frac{q_6}{q_1} \cdot \frac{K}{N} \cdot Q_1 \cdot (1 + Ki) \quad (3)$$

where $Q_1$: actually measured quantity of intake air in preceding intake stroke The equation (3) indicates that, on the basis of the actually measured quantity of intake air $Q_1$ in the immediately preceding intake stroke, the quantity of intake air in the present intake stroke (between the crank angles of 180° and 360°) is predicted at the sampling time of $q_6$ so as to determine the opening period $t_2$ of the injector 12 in the present intake stroke. The predicted intake air quantity $Q_2'$ is expressed as follows:

$$Q_2' = \frac{q_6}{q_1} \cdot Q_1 \quad (4)$$

Similarly, the intake air quantity $Q_3'$ predicted at the sampling time of $q_{11}$ is expressed as follows:

$$Q_3' = \frac{q_{11}}{q_6} \cdot Q_2 \quad (5)$$

where $Q_2$: actually measured quantity of intake air between crank angles of 180° and 360°.

It will be apparent from FIG. 6 that the intake air quantity $Q_2$ is not equal to the intake air quantity $Q_1$. When the engine is accelerated linearly, the ratio between the intake air quantity $Q_1$ in an intake stroke and that $Q_2$ in the next intake stroke should be approximately equal to the ratio between the instantaneous air flow rates $q_1$ and $q_6$ in the respective intake strokes. Accordingly, the intake air quantity $Q_2'$ predicted according to the equation (4) should be approximately equal to the intake air quantity $Q_2$ which cannot be computed until the instantaneous air flow rate $q_{11}$ is sampled. Similarly, the intake air quantity $Q_3'$ predicted according to the equation (5) should also be approximately equal to the intake air quantity $Q_3$. In this manner, the intake air quantity is predicted according to the present invention.

Figure 7:
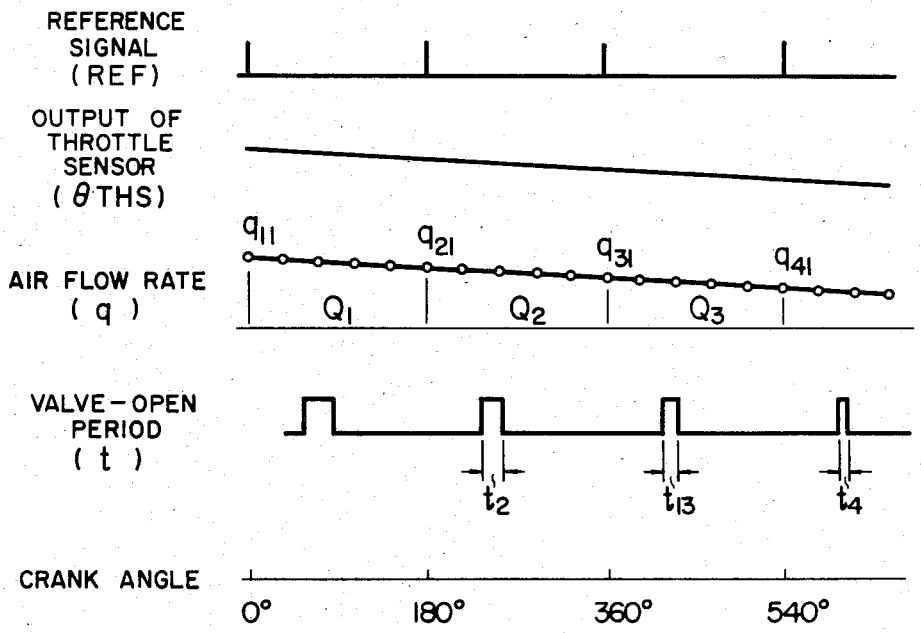
FIG. 7 illustrates the manner of signal processing according to the embodiment of the present invention in a low-rate deceleration mode in which the engine is relatively gradually decelerated.

On the other hand, FIG. 7 illustrates the fuel injection timing in the so-called low-rate deceleration mode where the throttle valve 14 is relatively gradually closed, hence, the level of the output signal of the throttle sensor θTHS decreases relatively gradually. The fuel injection control in this case is entirely similar to that effected in the low-rate acceleration above described, and the fuel injection period, hence, the opening period $t_2$ of the injector 12 is computed according to the following equation (6) similar to the equation (3):

$$t_2 = \frac{q_{21}}{q_{11}} \cdot \frac{K}{N} \cdot Q_1 \cdot (1 + K_i) \quad (6)$$

According to the embodiment of the present invention, therefore, the quantity of fuel required to be injected at required fuel injection timing can be sufficiently accurately computed, so that an undesirable time lag in the control can be eliminated, and the proper air-fuel ratio can be maintained even when the engine is then accelerated or decelerated.

Figure 8:
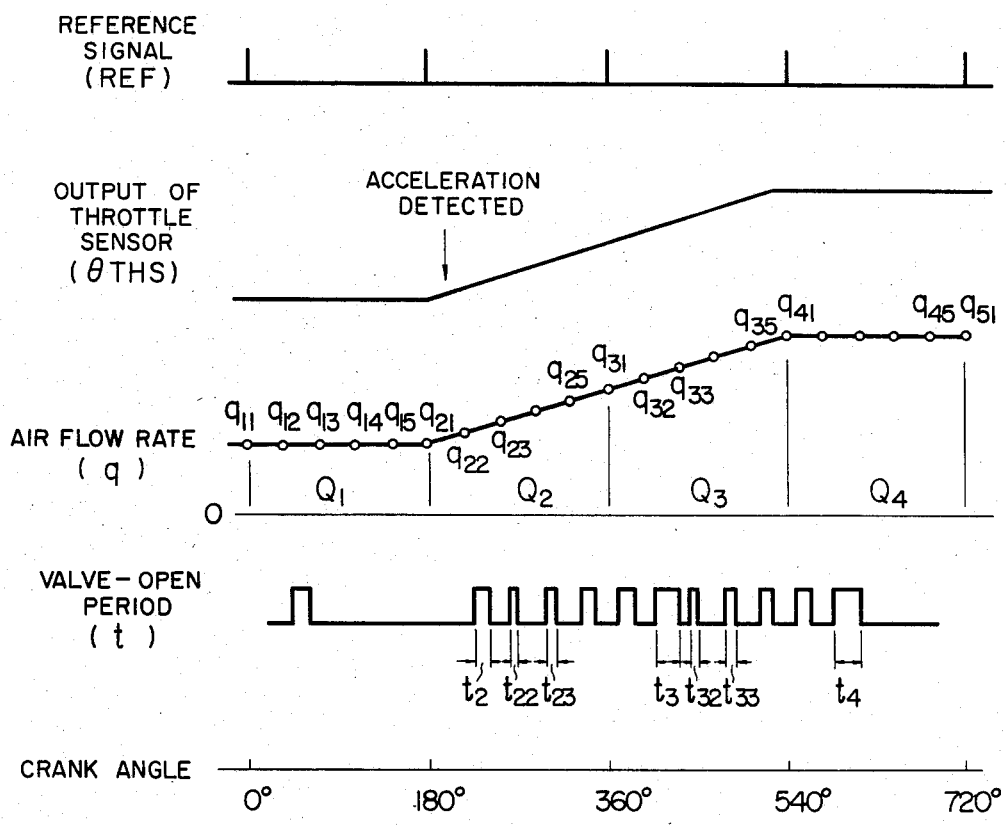
FIG. 8 illustrates the manner of signal processing according to the embodiment of the present invention in a high-rate acceleration mode in which the engine is very quickly accelerated.

FIG. 8 illustrates the fuel injection timing in the so-called high-rate acceleration mode where the throttle valve 14 is abruptly opened, hence, the level of the output signal of the throttle sensor θTHS shows an abrupt increase. In this case, the quantity of injected fuel is corrected or incremented to match the abrupt acceleration.

It will be apparent from FIG. 8 that, in such a case, the quantity of fuel to be supplied during the high-rate acceleration is computed on the basis of instantaneous air flow rates $q_{11}$, $q_{21}$, $q_{31}$ and $q_{41}$ sampled at intervals of the crank angle of 180° or in synchronism with the selected pulses of the output signal REF of the ANG 146. The instantaneous air flow rates $q_{11}$, $q_{21}$, $q_{31}$ and $q_{41}$ are sampled at intervals of the crank angle of 180° as seen in FIG. 8. This angular interval is 180° because the engine has four cylinders. That is, the angular interval is determined depending on the number of engine cylinders and is 120° and 90° when the engine has six cylinders and eight cylinders respectively. The reference angle above described is used also as the reference for ignition control. The instantaneous air flow rates $q_{11}$, $q_{21}$, $q_{31}$, $q_{41}$, $q_{51}$, . . . sampled at intervals of the reference angle of 180° are used to compute normal fuel injection periods $t_2$, $t_3$, $t_4$, . . . according to the equation (6). Although the equation (6) provides the fuel injection period $t_2$ in the case of the low-rate deceleration mode, the basic idea of computation of $t_2$ in the high-rate acceleration mode is the same.

The fuel injection periods are corrected or incremented to match the high-rate acceleration on the basis of intake air flow rates $q_{12}$ to $q_{15}$, $q_{22}$ to $q_{25}$, $q_{32}$ to $q_{35}$, $q_{42}$ to $q_{45}$, . . . sampled at intervals of the crank angle of 36° except the reference angle of 180°. Each of the fuel injection periods in this case is computed according to the difference between the instantaneous intake air flow rate sampled at one of the sampling points and that sampled at the immediately preceding sampling point.

Thus, for example, the fuel injection period $t_{22}$ in FIG. 8 is computed according to the following equation (7):

$$t_{22} = \frac{K}{N} \cdot (q_{22} - q_{21}) \cdot (1 + Ki) \quad (7)$$

Also, the fuel injection period $t_{23}$ is computed according to the following equation (8):

$$t_{23} = \frac{K}{N} \cdot (q_{23} - q_{22}) \cdot (1 + Ki) \quad (8)$$

Figure 9:
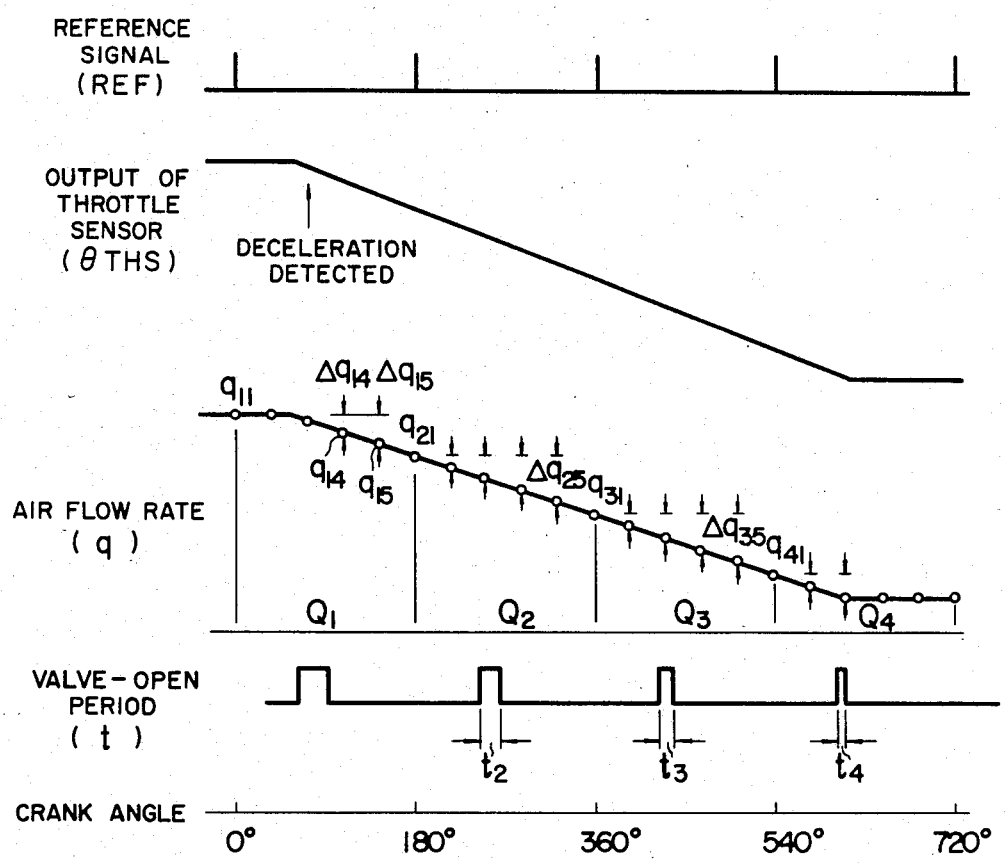
FIG. 9 illustrates the manner of signal processing according to the embodiment of the present invention in a high-rate deceleration mode in which the engine is very quickly decelerated.

On the other hand, FIG. 9 illustrates the fuel injection timing in the so-called high-rate deceleration mode where the throttle valve 14 is abruptly closed, hence, the level of the output signal of the $\theta$THS 116 shows an abrupt decrease. In this case, the quantity of injected fuel is corrected or decremented to match the abrupt deceleration.

The fuel quantity correction or decrementing in this case differs from the fuel quantity correction or incrementing described with reference to FIG. 8, and the fuel injection periods are computed on the basis of the instantaneous air flow rates sampled in synchronism with the reference signal REF. For example, the normal fuel injection period $t_2$ in FIG. 9 is computed by subtracting, from the predicted air quantity $Q_2'$, the decrements $\Delta q_{14}$ and $\Delta q_{15}$ of $q_{14}$ and $q_{15}$ from the instantaneous air flow rate sampled at the deceleration starting point in the immediately preceding intake stroke, taking into account the mode of deceleration.

Therefore, the fuel injection period $t_2$ is computed according to the following equation (9), and the succeeding fuel injection period $t_3$ is similarly computed according to the following equation (10):

$$t_2 = \frac{K}{N} \cdot (1 + Ki)\left\{ \frac{q_{21}}{q_{22}} \cdot Q_1 - (\Delta q_{14} + \Delta q_{15}) \right\} \quad (9)$$

$$t_3 = \frac{K}{N} \cdot (1 + Ki)\left\{ \frac{q_{31}}{q_{21}} \cdot Q_2 - (\Delta q_{22} + \Delta q_{23} + \Delta q_{24} + \Delta q_{25}) \right\} \quad (10)$$

Thus, according to the embodiment of the present invention, the fuel quantity can be sufficiently corrected or incremented or decremented to match the mode of acceleration or deceleration of the engine (the so-called high-rate acceleration or high-rate deceleration mode described above), so that the operability of the engine can be improved.

Figure 10:
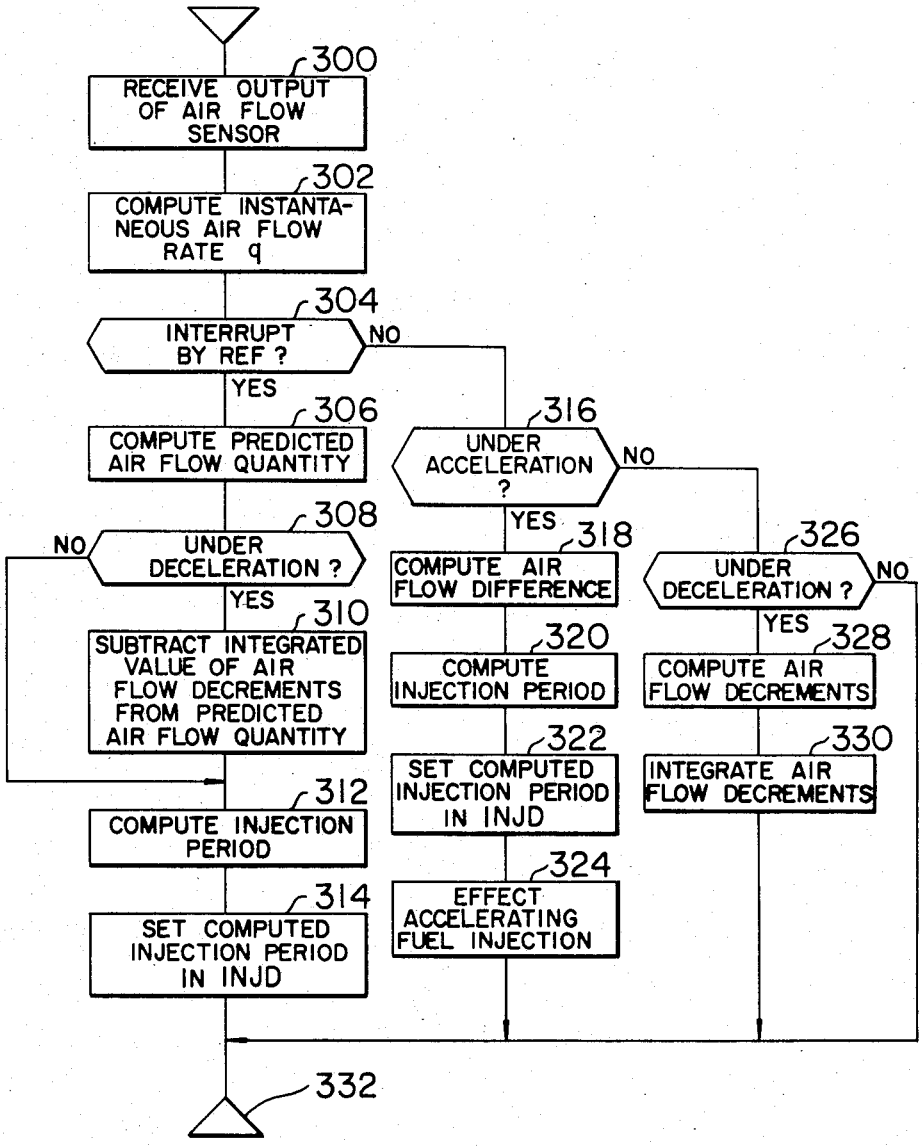
FIG. 10 is a flow chart showing the steps of control according to the embodiment of the present invention.

FIG. 10 is a flow chart showing one form of a routine required for execution of the control described with reference to FIGS. 6 to 9, to illustrate the steps executed under control of the CPU 102 in the control circuit 64 shown in FIGS. 2 and 3.

This routine is generally run in the form of an interrupt routine. The condition for running this interrupt routine is such that the routine is run whenever the crank angle attains a predetermined setting of, for example, 36° as shown in FIG. 4, that is, response to the appearance of the pulses of the reference signal REF.

When the routine starts, the data of the output of the AFS 24 is supplied to the $ADC_2$ in the step 300. In the next step 302, the instantaneous intake air flow rate q is computed. In the step 304, whether or not the reference signal REF is applied for running the interrupt routine is judged, and, when the result of judgment is "YES", the step 304 is followed by the step 306.

In the step 306, the predicted intake air quantity, for example, $Q_2'$ is computed, and the step 306 is followed by the step 308. In the step 308, whether or not the engine is under deceleration or under the so-called high-rate deceleration is judged. When the result of judgment is "YES", the step 308 is followed by the step 310. In the step 310, the integrated value of the flow rate decrements is subtracted from the data computed in the step 306. On the other hand, when the result of judgment in the step 308 is "NO", the step 308 is followed by the step 312.

In the step 312, the fuel injection period, for example, $t_2$ at the timing of the reference signal REF is computed, and the data is registered in the register INJD of the INJC 134 (FIG. 3) in the next step 314.

On the other hand, when the result of judgment in the step 304 is "NO", the step 304 is followed by the step 316. In the step 316, whether or not the engine is under acceleration or under the so-called high-rate acceleration is judged. When the result of judgment in the step 316 is "YES", the step 316 is followed by the step 318. In the step 318, the air flow rate difference, for example, $(q_{22}-q_{21})$ in the equation (7) is computed. Then, in the step 320, the fuel injection period, for example, $t_{22}$ shown in FIG. 8 and given by the equation (7) is computed, and the data is registered in the register INJD in the step 322. In the next step 324, fuel is injected according to the data registered in the register INJD.

This fuel injection, when the engine is under the so-called high-rate acceleration, is effected under control of a circuit commonly known in the art. When the I/O circuit 108 shown in FIG. 3 is provided by, for example, the circuit described in U.S. Pat. No. 4,276,601, setting of zero in the CYL register 404 shown in FIG. 7 of the cited U.S. patent starts the accelerating fuel injection. The fuel injection period is determined by the data registered in the INJD register 412 (corresponding to the INJD 134 in the present embodiment).

When the result of judgment in the step 316 is "NO", the step 316 is followed by the step 326. In the step 326, judgment is made as to whether or not the engine is under deceleration or under the so-called high-rate deceleration. When the result of judgment in the step 326 is "YES", the step 326 is followed by the step 328. In the step 328, the air flow decrements, for example, $\Delta q_{14}$ and $\Delta q_{15}$ are computed, and, in the next step 330, the air flow decrements $\Delta q_{14}$ and $\Delta q_{15}$ are integrated to be used in the computation in the step 310.

On the other hand, when the result of judgment in the step 326 is "NO", the step 326 is followed directly by the step 332 which indicates the end of the interrupt routine.

According to the embodiment of the present invention, therefore, the intake air quantity predicted for computation of the injected fuel quantity in an intake stroke shows a satisfactory coincidence with the actual intake air quantity in the succeeding intake stroke, so that the optimum air-fuel ratio can be maintained even in a transient state of engine operation in which the intake air quantity in an intake stroke changes from that in another intake stroke. In addition, due to the fact that the quantity of fuel supplied during acceleration of the engine is incremented on the basis of the newest data of the instantaneous intake air flow rate, there is substantially no time lag of response, and the engine can be always satisfactorily accelerated. Further, the quantity of fuel supplied during deceleration of the engine is accurately decremented, and there is no possibility of increasing the CO concentration of exhaust gases during deceleration.

Although the intake air quantity in each intake stroke is predicted by computation on the basis of the instantaneous intake air flow rates sampled at the generation timing of the reference signal REF in the aforementioned embodiment, it may be predicted on the basis of the instantaneous intake air flow rates sampled at any other timing.

Further, although the predicted intake air quantities, for example, $Q_2'$ and $Q_3'$ are computed according to the equations (4) and (5) respectively, the instantaneous intake air flow rate sampled at selected timing may be multiplied by five (when the number of sampling points is five per intake stroke), and each of the predicted intake air quantities may be computed on the basis of the result of multiplication.

In the aforementioned embodiment, fuel incremented to deal with the high-rate acceleration mode is injected in the so-called constant-angle injection mode in which fuel is injected at intervals of the crank angle of 36°. However, the injector has a minimum injection period which is a controllable limit. Therefore, when the injection period per injection stroke of the injector is found to be equal to or less than the minimum, such an injection period may be integrated a plurality of times, and fuel may be injected over the resultant injection period.

Similarly, the number of times of fuel injection in the high-rate acceleration mode of the engine may not be maintained constant but may be made variable depending on the rotation speed of the engine.

In the aforementioned embodiment, it is assumed that there is no change in the rotation speed of the engine in each of the intake strokes. However, if the rotation speed of the engine can be detected at intervals of the predetermined crank angle, the injection period can be corrected or incremented or decremented on the basis of the instantaneous values of the detected engine rotation speed so that the injection period can be more accurately controlled.

Further, although the CPU 102 processes the signals at the timing of predetermined crank angles represented by the output signals REF and POS from the ANG 146 in the aforementioned embodiment, it is apparent that the signals may be processed according to the so-called constant-time signal processing mode in which the signals are processed at intervals of a predetermined time.

Furthermore, although whether the engine is under acceleration or deceleration is judged on the basis of the level of the output signal of the θTHS 116 in the aforementioned embodiment, whether the engine is under acceleration or deceleration may be judged on the basis of the ratio between the instantaneous intake air flow rate sampled at the generation timing of the reference signal REF in an intake stroke and that sampled in the immediately preceding intake stroke.

In the aforementioned embodiment, fuel incremented to deal with the high-rate acceleration mode is injected throughout the length of time in which the engine is under continuous acceleration as will be apparent from FIG. 8. However, incrementing of fuel may be limited to the first intake period following the detection of the acceleration. For example, in the case of FIG. 8, fuel incrementing may be applied only to the range of from $t_2$ to $t_3$ in injection timing and may not be applied to the range of from $t_3$ to $t_4$.

In the aforementioned embodiment, the fuel injection valve is opened at an angle delayed by a predetermined angle from the time of generation of the reference pulse signal REF from the ANG 146. Such a circuit can be achieved by the already known circuit disclosed in U.S. Pat. No. 4,276,601 cited hereinbefore. The phase angle of the pulse signal REF and that of the open timing of the fuel injection valve are set in the INTL register 406 shown in FIG. 7 of the U.S. patent. Then, a "1" is set in the CYL register 404, so that fuel can be injected at the timing shifted by the predetermined phase angle from the pulse signal REF.

It will be understood from the foregoing detailed description of the present invention that a predicted intake air quantity sufficiently close to the actual intake air quantity supplied at the fuel injection timing can be computed, and fuel in a quantity matching the predicted intake air quantity can be injected, so that the engine can be operated while maintaining the optimum air-fuel ratio.

In the case of the so-called high-rate acceleration mode, fuel can be injected in a quantity matching the intake air quantity changing at every moment, so that the engine can be sufficiently accelerated. In such a case, the less the change in the air flow rate, the smaller is the injected fuel quantity, and the more the change in the air flow rate, the larger is the injected fuel quantity. Accordingly, fuel matching the velocity of air flow can be supplied, and fuel can be smoothly entrained on the stream of intake air, so that the satisfactory air-fuel mixture can be supplied for sufficiently accelerating the engine.

Also, in the case of the so-called high-rate deceleration mode, the fuel quantity which may be excessively injected in an intake stroke can be immediately corrected in the next intake stroke, thereby reliably preventing occurrence of the CO spike phenomenon in exhaust gases.

What is claimed:

1. A method of controlling an engine including the steps of sampling instantaneous flow rates of intake air supplied to the engine a plurality of times during each intake stroke, computing the quantity of intake air to be supplied to the engine in an intake stroke on the basis of the sampled instantaneous intake air flow rates, computing the quantity of injected fuel on the basis of the computed intake air quantity, and injecting the computed quantity of fuel to the engine, wherein said step of computing the injected fuel quantity includes computing the ratio between the instantaneous intake air flow rate sampled at a reference timing in the preceding intake stroke and that sampled at a reference timing in the present intake stroke and correcting the quantity of intake air to be supplied in the present intake stroke on the basis of said computed ratio, and wherein said quantity of injected fuel is computed on the basis of said corrected quantity of intake air.

2. A method of controlling an engine as claimed in claim 1, wherein said step of coputing the injected fuel quantity includes judging whether or not the engine is under acceleration, computing the air flow difference between an instantaneous intake air flow rate sampled in the present intake stroke and a preceding intake air flow rate sampled in the present intake stroke when it is judged that the engine is under acceleration, computing an accelerating fuel injection period on the basis of the computed air flow difference, and injecting accelerating fuel according to the computed fuel injection period.

3. A method of controlling an engine as claimed in claim 1, wherein said step of computing the injected fuel quantity comprises a first step of judging whether or not the engine is under deceleration, a second step of computing the difference between the instantaneous intake air flow rate sampled at a reference timing in the preceding intake stroke and another instantaneous intake air flow rate sampled in the preceding intake stroke when it is judged that the engine is under deceleration, a third step of obtaining a sum of the computed air flow differences obtained by executing the second step successively during the preceding intake stroke, and a fourth step of subtracting the sum of the air flow differences obtained in the third step from said corrected quantity of intake air to be supplied in the present intake air stroke, said quantity of injection fuel being computed on the basis of the quantity of intake air obtained in the fourth step.

* * * * *